US010360845B2

(12) United States Patent
Park et al.

(10) Patent No.: US 10,360,845 B2
(45) Date of Patent: Jul. 23, 2019

(54) DISPLAY DEVICE

(71) Applicant: SAMSUNG DISPLAY CO., LTD., Yongin, Gyeonggi-Do (KR)

(72) Inventors: Kyong Tae Park, Suwon-si (KR); Yu Hyun Cho, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 453 days.

(21) Appl. No.: 14/702,629

(22) Filed: May 1, 2015

(65) Prior Publication Data

US 2016/0140897 A1 May 19, 2016

(30) Foreign Application Priority Data

Nov. 18, 2014 (KR) ..... 10-2014-0161066

(51) Int. Cl.
*G09G 3/3225* (2016.01)

(52) U.S. Cl.
CPC ... *G09G 3/3225* (2013.01); *G09G 2300/0413* (2013.01); *G09G 2320/0238* (2013.01); *G09G 2320/045* (2013.01); *G09G 2330/08* (2013.01); *G09G 2330/10* (2013.01)

(58) Field of Classification Search
CPC ..... G09G 3/3225; G09G 2300/0413; G09G 2320/0238; G09G 2320/045; G09G 2330/08; G09G 2330/10
See application file for complete search history.

(56) References Cited

U.S. PATENT DOCUMENTS

2004/0141131 A1* 7/2004 Ishikawa ..... G09G 3/006 349/139
2009/0160743 A1* 6/2009 Tomida ..... G09G 3/3233 345/80
2015/0262526 A1 9/2015 Park et al.
(Continued)

FOREIGN PATENT DOCUMENTS

JP 2007-316511 A 12/2007
KR 10-2004-0006987 A 1/2004
KR 10-0666639 B1 1/2007
(Continued)

OTHER PUBLICATIONS

Abstract and Machine English Translation of KR 10-2015-0044328 A, Apr. 24, 2015, 32 Pages.

*Primary Examiner* — LaTanya Bibbins
(74) *Attorney, Agent, or Firm* — Lewis Roca Rothgerber Christie LLP

(57) ABSTRACT

A display device. A display including a display panel configured to include a plurality of active pixels and a plurality of dummy pixels, which are formed near the active pixels, a control driver configured to control a pixel driving circuit formed in each of the active pixels and a dummy driving circuit formed in each of the dummy pixels, wherein each of the pixel driving circuits of the active pixels includes a pixel driving transistor and each of the dummy driving circuits of the dummy pixels, which are formed at either end of the display panel in a first direction, is electrically connected at a first dummy node thereof and includes a dummy driving transistor and a first dummy capacitor, which connects a control terminal of the dummy driving transistor and the first dummy node.

8 Claims, 17 Drawing Sheets

(56) References Cited

U.S. PATENT DOCUMENTS

2016/0247869 A1* 8/2016 Li ..... G09G 3/3225

FOREIGN PATENT DOCUMENTS

| | | | | |
|---|---|---|---|---|
| KR | 100666639 | B1 | * | 1/2007 |
| KR | 10-2011-0057552 | A | | 6/2011 |
| KR | 10-2014-0137504 | A | | 12/2014 |
| KR | 10-2015-0044328 | A | | 4/2015 |
| KR | 10-2015-0107018 | | | 9/2015 |

* cited by examiner

DISPLAY DEVICE

CROSS-REFERENCE TO RELATED APPLICATION

This application claims priority to and the benefit of Korean Patent Application No. 10-2014-0161066 filed on Nov. 18, 2014 in the Korean Intellectual Property Office, the disclosure of which is incorporated herein by reference in its entirety.

BACKGROUND

1. Field

The invention relates to a display device, and more particularly, to a repairable display device.

2. Description of the Related Art

Display devices are devices visually presenting data. Examples of display devices may include a liquid crystal display (LCD) device, an electrophoretic display (EPD) device, an organic light-emitting display device, an inorganic electroluminescent (EL) display device, a field emission display (FED) device, a surface-conduction electron-emitter display (SED) device, a plasma display device, and a cathode ray tube (CRT) display device.

In particular, the organic light-emitting display device is a type of display device which displays image or text data by using light generated in response to holes from an anode electrode and electrons from a cathode electrode being combined together in an organic layer between the anode electrode and the cathode electrode.

Display devices may be classified into a passive matrix display device and an active matrix display device according to a driving method of an N×M matrix of pixels thereof. The active matrix display device may consume less power than the passive matrix display device, and is thus more suitable than the passive matrix display device for the realization of a large-size display. Also, the active matrix display device may provide a higher resolution than the passive matrix display device. The active matrix display device includes pixel driving circuits connected to liquid crystal capacitors or LEDs.

Each pixel driving circuit includes a thin-film transistor (TFT) and a capacitor. In an LCD device or an organic light-emitting display device, defects may occur in pixel driving circuits, i.e., in the TFTs or the capacitors of pixel driving circuits. A defect occurring in a pixel driving circuit, or in the LED or the liquid crystal capacitor connected to the pixel driving circuit, may cause a dark- or bright-spot defect. Pixel defects caused by defective pixel driving circuits are generally difficult to locate with precision, and even if they could be located, it is almost impossible to repair them through the application of laser beams because pixel driving circuits are generally located deep inside the display device near the substrate. Therefore, in reality, it is very difficult to repair defective pixels caused by defects in pixel driving circuits.

SUMMARY

Exemplary embodiments of the invention provide an organic light-emitting display device capable of repairing defective pixels caused by defects in pixel driving circuits.

Exemplary embodiments of the present invention also provide a display device capable of preventing minute errors in a driving current that may occur in repaired pixels at low or high grayscale.

However, exemplary embodiments of the present invention are not restricted to those set forth herein. The above and other exemplary embodiments of the present invention will become more apparent to one of ordinary skill in the art to which the invention pertains by referencing the detailed description of the invention given below.

According to an embodiment of the present invention there is provided a display device, including: a display panel including a plurality of active pixels and a plurality of dummy pixels located at one or both ends of the display panel in a first direction; a control driver configured to control a pixel driving circuit in each of the active pixels and a dummy driving circuit in each of the dummy pixels, wherein each of the pixel driving circuits includes a pixel driving transistor and each of the dummy driving circuits includes a dummy driving transistor, the dummy driving circuit is configured to be electrically coupled at a first dummy node of the respective dummy driving circuit, the dummy driving circuit further includes a first dummy capacitor for coupling the control terminal and the first dummy node.

In one embodiment, the display includes: a repair line configured to extend in the first direction, wherein the repair line overlaps the active pixels aligned in the first direction.

In one embodiment, the repair line is electrically connected to the pixel driving circuits of some of the active pixels at first pixel nodes thereof.

In one embodiment, the control driver includes a comparator configured to determine whether or not each of the pixel driving circuits of the active pixels is defective and a synchronizer configured to synchronize an output signal of each of the dummy driving circuits of the dummy pixels with a data signal provided to each of the pixel driving circuits of the active pixels.

In one embodiment, the comparator is configured to control a connection between the repair line and a first pixel node.

In one embodiment, each of the dummy driving circuits of the dummy pixels includes a first dummy transistor and a second dummy transistor, which connect a terminal to which an initialization voltage is applied and the first dummy node, and a pumping capacitor, to which the first and second dummy transistors are connected, a control terminal of the first dummy transistor is connected to a first input signal terminal, a source terminal of the first dummy transistor is connected to the dummy node, a drain terminal of the first dummy transistor is connected to a source terminal of the second dummy transistor, a control terminal of the second dummy transistor is connected to a second input signal terminal, the source terminal of the second dummy transistor is connected to the drain terminal of the first dummy transistor, and a drain terminal of the second dummy transistor is connected to a second power supply voltage terminal.

In one embodiment, each of the pixel driving circuits of the active pixels includes a first pixel transistor and a second pixel transistor, a control terminal of the first pixel transistor is connected to the second input signal terminal, and a control terminal of the second pixel transistor is connected to a third input signal terminal.

In one embodiment, each of the pixel driving circuits of the active pixels includes a first pixel transistor and a second pixel transistor, a control terminal of the first pixel transistor and a control terminal of the second pixel transistor are electrically connected together, and the control terminal of the first pixel transistor is connected to the second input signal terminal.

According to an embodiment of the present invention there is provided a display device, including: a display panel including a plurality of active pixels and a plurality of dummy pixels located at one or both ends of the display panel in a first direction; a control driver configured to control a pixel driving circuit in each of the active pixels and a dummy driving circuit in each of the dummy pixels, wherein each of the pixel driving circuits includes a pixel driving transistor and each of the dummy driving circuits includes a dummy driving transistor, wherein each of the pixel driving circuits includes a pixel driving transistor and each of the dummy driving circuits includes a dummy driving transistor, the dummy driving circuit is configured to be electrically coupled at a first dummy node of the respective dummy driving circuit, the dummy driving circuit further includes a first dummy capacitor for coupling the control terminal and the first dummy node, a boost diode, and a first transistor, which is configured to apply a voltage at an anode terminal of the boost diode to a third dummy node.

In one embodiment, the display includes: a repair line configured to extend in the first direction, wherein the repair line overlaps the active pixels aligned in the first direction.

In one embodiment, the pixel driving circuits of some of the active pixels are electrically connected at first pixel nodes thereof.

In one embodiment, the control driver includes a comparator, configured to determine whether each of the pixel driving circuits of the active pixels is defective and a synchronizer, configured to synchronize an output signal of each of the dummy driving circuits of the dummy pixels with a data signal provided to each of the pixel driving circuits of the active pixels.

In one embodiment, the comparator is configured to control a connection between the repair line and a first pixel node.

In one embodiment, each of the pixel driving circuits of the active pixels includes a first pixel transistor and a second pixel transistor, a control terminal of the first pixel transistor is connected to a second input signal terminal, and a control terminal of the second pixel transistor is connected to a third input signal terminal.

In one embodiment, each of the pixel driving circuits of the active pixels includes a first pixel transistor and a second pixel transistor, a control terminal of the first pixel transistor and a control terminal of the second pixel transistor are electrically connected together, and the control terminal of the first pixel transistor is connected to a second input signal terminal.

In one embodiment, each of the dummy pixels is connected to an initialization line, which extends in a second direction, and the initialization line is connected to each of the boost diodes of the dummy driving circuits such that an initialization voltage is applied to the initialization line in response to an initialization signal.

In one embodiment, the display includes: a boost capacitor configured to connect a first input terminal and the control terminal of a first dummy transistor.

According to an embodiment of the present invention there is provided a display device, including: a display panel including a plurality of active pixels and a plurality of dummy pixels located at one or both ends of the display panel in a first direction; a control driver configured to control a pixel driving circuit in each of the active pixels and a dummy driving circuit in each of the dummy pixels, wherein each of the pixel driving circuits includes a pixel driving transistor, each of the dummy driving circuits includes a dummy driving transistor, the dummy driving circuit is configured to be electrically coupled at a first dummy node of the respective dummy driving circuit, the dummy driving circuit further includes a first dummy capacitor for coupling the control terminal and the first dummy node, and a fourth dummy transistor, which connects the first dummy node and a first power supply voltage terminal, and a control terminal and a source terminal of the fourth dummy transistor are electrically connected.

In one embodiment, the control driver includes a comparator, configured to determine whether each of the pixel driving circuits of the active pixels is defective and a synchronizer, configured to synchronize an output signal of each of the dummy driving circuits of the dummy pixels with a data signal provided to each of the pixel driving circuits of the active pixels.

In one embodiment, the display includes: a repair line configured to extend in the first direction, wherein the repair line overlaps the active pixels aligned in the first direction.

According to the exemplary embodiments, no pixel defects may be caused even in pixels with defective pixel driving circuits. As a result, pixel defects may be considerably reduced, and thus, the yield may be improved.

In addition, it is possible to prevent a phenomenon in which an organic light-emitting diode (OLED) emits too bright a light in response to the receipt of low-grayscale data or emits too dark a light in response to the receipt of high-grayscale data.

Other features, aspects, and embodiments will be apparent from the following detailed description, the drawings, and the claims.

DETAILED DESCRIPTION

Figure 1:
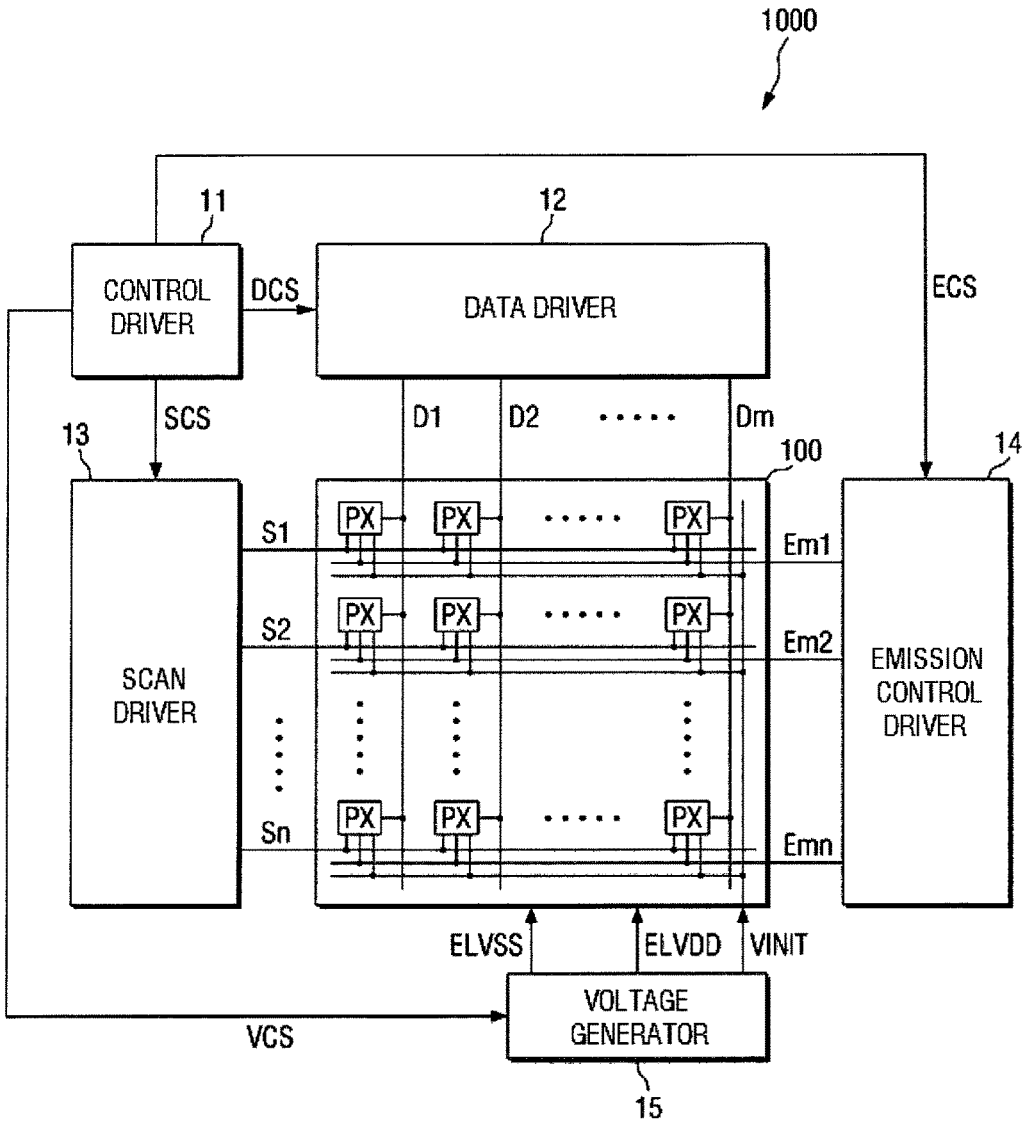
FIG. 1 is a block diagram of a display device according to an exemplary embodiment of the invention.

The aspects and features of embodiments of the present invention and methods for achieving the aspects and features will be apparent by referring to the embodiments to be described in detail with reference to the accompanying drawings. However, the present invention is not limited to the embodiments disclosed hereinafter, but can be implemented in diverse forms. The matters defined in the description, such as the detailed construction and elements, are nothing but specific details provided to assist those of ordinary skill in the art in a comprehensive understanding of the invention, and the present invention is only defined within the scope of the appended claims and their equivalents.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art. As used herein, the term "major component" means a component constituting at least half, by weight, of a composition, and the term "major portion", when applied to a plurality of items, means at least half of the items.

As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present invention". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

The display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate as the display device. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Exemplary embodiments of the present invention will hereinafter be described in detail with reference to the accompanying drawings.

FIG. 1 is a block diagram of a display device according to an exemplary embodiment of the present invention.

Referring to FIG. 1, an organic light-emitting display device 1000 includes a display panel 100.

The display panel 100 may include a plurality of pixels PX and interconnections for transmitting signals to the pixels PX. The pixels PX may be arranged in a matrix. Each of the pixels PX may emit one of red light, green light and blue light. The emission of light by the pixels PX may be controlled by first through n-th scan signals S1, S2, . . . , Sn, first through m-th data signals D1, D2, . . . , Dm, and first through n-th emission signals Em1, Em2, . . . , Emn. The first through n-th scan signals S1, S2, . . . , Sn may control the pixels PX to receive, or not to receive, the first through m-th data signals D1, D2, . . . , Dm. The first through m-th data signals D1, D2, . . . , Dm may include luminance information relating to the luminance of light emitted by the pixels PX. The first through m-th emission signals Em1, Em2, . . . , Emn may control the emission of light by the pixels PX.

The interconnections may include interconnections for transmitting the first through n-th scan signals S1, S2, . . . , Sn, the first through m-th data signals D1, D2, . . . , Dm, the first through n-th emission signals Em1, Em2, . . . , Emn, and an initialization voltage VINIT. The interconnections for transmitting the first through n-th scan signals S1, S2, . . . , Sn and the first through n-th emission signals Em1, Em2, . . . , Emn may be arranged to extend in a row direction of the pixels PX. The interconnections for transmitting the first through m-th data signals D1, D2, . . . , Dm may be arranged to extend in a column direction of the pixels PX. The interconnections for transmitting the initialization voltage VINIT may be arranged to extend in the row direction of the pixels PX. The interconnections for transmitting the initialization voltage VINIT may be formed in a zigzag shape.

The organic light-emitting display device 1000 may also include a driver unit and a voltage generator 15.

The driver unit includes a control driver 11, a data driver 12, a scan driver 13 and an emission control driver 14. The control driver 11 may receive image data from an external source (not illustrated), and may generate a scan driver control signal SCS, which is for controlling the scan driver 13, a data driver control signal DCS, which is for controlling the data driver 12, an emission control driver control signal ECS, which is for controlling the emission control driver 14, and a voltage generator control signal VCS, which is for controlling the voltage generator 15, according to the received image data.

The data driver 12 may receive the data driver control signal DCS, and may generate the first through m-th data signals D1, D2, . . . , Dm according to the data driver control signal DCS.

The scan driver 13 may receive the scan driver control signal SCS, and may generate the first through n-th scan signals S1, S2, . . . , Sn according to the scan driver control signal SCS.

The emission control driver 14 may receive the emission control driver control signal ECS, and may generate the first through n-th emission signals Em1, Em2, . . . , Emn according to the emission control driver control signal ECS.

The voltage generator 15 may generate the initialization voltage VINIT, a first power supply voltage ELVDD and a second power supply voltage ELVSS, and may provide the initialization voltage VINIT, the first power supply voltage ELVDD and the second power supply voltage ELVSS to the display panel 100. In an exemplary embodiment, the initialization voltage VINIT, the first power supply voltage ELVDD and the second power supply voltage ELVSS may be variable, and the control driver 11 may control the voltage generator 15 to make the initialization voltage VINIT, the first power supply voltage ELVDD and the second power supply voltage ELVSS variable.

Figure 2:
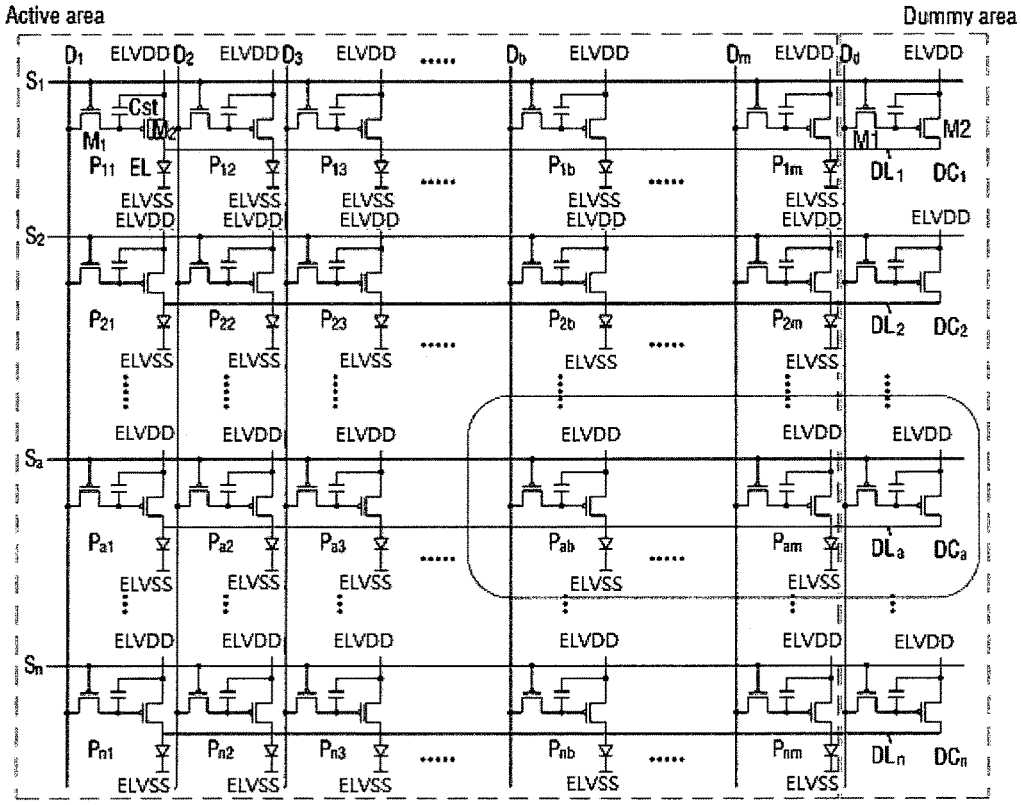
FIG. 2 is a circuit diagram of a pixel array of the display device according to the exemplary embodiment of FIG. 1.

FIG. 2 is a circuit diagram of a pixel array of the display device according to the exemplary embodiment of FIG. 1.

Referring to FIG. 2, a substrate includes an active area and a dummy area, which is provided near the active area.

In the active area, a plurality of pixels P11, P12, . . . , Pnm may be arranged, and in the dummy area, a plurality of dummy cells DC1, DC2, . . . , DCa, . . . , DCn may be arranged. A plurality of scan lines S1, S2, . . . , Sa, . . . , Sn may be arranged in both the active area and the dummy area in one direction. In the active area, a plurality of data lines D1, D2, . . . , Db, . . . , Dm may be arranged to cross the scan lines S1, S2, . . . , Sa, . . . , Sn. As a result, the pixels P11, P12, . . . , Pnm may be defined by the crossing regions between the scan lines S1, S2, . . . , Sa, . . . , Sn and the data lines D1, D2, . . . , Db, . . . , Dm. A dummy data line Dd may be arranged in the dummy area to cross the scan lines S1, S2, . . . , Sa, . . . , Sn. As a result, the dummy cells DC1, DC2, . . . , DCa, . . . , DCn may be defined by the crossing regions between the scan lines S1, S2, . . . , Sa, . . . , Sn and the dummy data line Dd.

Each of the pixels P11, P12, . . . , Pnm may include a pixel electrode and a pixel driving circuit "Active Pixel" electrically connected to the pixel electrode. As used herein, a pixel driving circuit "Active Pixel" means a pixel driving circuit of an active pixel. Similarly, a pixel electrode "Active Pixel" means a pixel electrode of an active pixel", and a dummy driving circuit "Dummy Pixel" means a dummy driving circuit of a dummy pixel.

The pixel driving circuit "Active Pixel" may include a switching transistor M1, a capacitor Cst, and a driving transistor M2. The gate terminal of the switching transistor M1 may be connected to one of the scan lines S1, S2, . . . , Sa, . . . , Sn, and the source terminal of the switching transistor M1 may be connected to one of the data lines D1, D2, . . . , Db, . . . , Dm. Accordingly, the switching transistor M1 may switch a data signal applied to one of the data lines D1, D2, . . . , Db, . . . , Dm connected thereto in accordance with a scan signal applied to one of the scan lines S1, S2, . . . , Sa, . . . , Sn connected to the switching transistor M1. The capacitor Cst may be connected between the drain terminal of the switching transistor M1 and a line to which the first power supply voltage ELVDD is applied, and may maintain the data signal for a predetermined or set amount of time. The gate terminal of the driving transistor M2 may be connected to the capacitor Cst, the source terminal of the driving transistor M2 may be connected to the line to which the first power supply voltage ELVDD is applied, and the drain terminal of the driving transistor M2 may be connected to a light-emitting device EL. Accordingly, the driving transistor M2 may supply a current corresponding to the data signal applied to the switching transistor M1 through the light-emitting device EL, via the pixel electrode of the light-emitting device EL. The light-emitting device EL may emit light in response to the current supplied through it.

The pixel driving circuit "Active Pixel" is described below in further detail with reference to FIG. 3.

Each of the dummy cells DC1, DC2, . . . , DCa, . . . , DCn may include a dummy driving circuit "Dummy Pixel" for applying electric signals to a corresponding pixel electrode.

The dummy driving circuit "Dummy Pixel" may be connected to one of the scan lines S1, S2, . . . , Sa, . . . , Sn, to the dummy data line Dd, and to a terminal for the first power supply voltage ELVDD.

The dummy driving circuit "Dummy Pixel", like the pixel driving circuit "Active Pixel", may include a switching transistor M1, a capacitor Cst, and a driving transistor M2. More specifically, the gate terminal of the switching transistor M1 may be connected to one of the scan lines S1, S2, . . . , Sa, . . . , Sn, and the source terminal of the switching transistor M1 may be connected to the dummy data line Dd. Accordingly, the switching transistor M1 may switch a data signal applied to the dummy data line Dd in accordance with a scan signal applied to one of the scan lines S1, S2, . . . , Sa, . . . , Sn connected to the switching transistor M1. The capacitor Cst may be connected between the drain terminal of the switching transistor M1 and the terminal for the first power supply voltage ELVDD, and may maintain the data signal for a predetermined amount of time. The gate terminal of the driving transistor M2 may be connected to the capacitor Cst, and the source terminal of the driving transistor M2 may be connected to the terminal for the first power supply voltage ELVDD.

A plurality of dummy lines DL1, DL2, . . . , DLa, . . . , DLn may be provided in the dummy area. The dummy lines DL1, DL2, . . . , DLa, . . . , DLn may be electrically connected to the dummy driving circuits of the dummy cells DC1, DC2, . . . , DCa, . . . , DCn, respectively, and particularly, to the drain terminals of the driving transistors M2 of the dummy cells DC1, DC2, . . . , DCa, . . . , DCn, respectively. The dummy lines DL1, DL2, . . . , DLa, . . . , DLn may extend into the active area, and may be disposed below the pixel electrodes of the pixels P11, P12, . . . , Pnm. The pixel electrodes of the pixels P11, P12, . . . , Pnm may overlap the dummy lines DL1, DL2, . . . , DLa, . . . , DLn, respectively.

During the fabrication of an organic light-emitting display device, defects may occur in the pixel driving circuits of some pixels, in which case, the light-emitting devices EL connected to the defective pixel driving circuits may not be lit even when turned on or may be lit even when turned off, thereby causing dark- or bright-spot defects.

To repair such defects, the interconnections between the defective pixel driving circuits and their respective light-emitting devices may be cut. For example, in response to a pixel Pab becoming defective due to a defect in a pixel driving circuit "Active Pixel" thereof, the interconnection between the pixel driving circuit "Active Pixel" and a light-emitting device EL of the pixel Pab, and particularly, the interconnection between a driving transistor M2 and the light-emitting device EL of the pixel Pab, may be cut. In a case when no electric signals are transmitted to the light-emitting device EL of the pixel Pab due to the defect in the pixel driving circuit "Active Pixel" of the pixel Pab, it may be unnecessary to cut the interconnection between the pixel driving circuit "Active Pixel" and the light-emitting device EL of the pixel Pab. Thereafter, the pixel electrode "Active Pixel" of the pixel Pab may be electrically connected to the dummy line DLa, which is disposed below the pixel electrode "Active Pixel" of the pixel Pab, by using, for example, a laser repair method. As a result, the pixel electrode "Active Pixel" of the pixel Pab may be electrically connected to the dummy driving circuit "Dummy Pixel" in the dummy cell DCa. The pixel Pab may then be driven by selecting the scan line Sa and applying a data voltage to the dummy data line Dd.

Accordingly, the pixel Pab may not exhibit any bright- or dark-spot defect.

Figure 3:
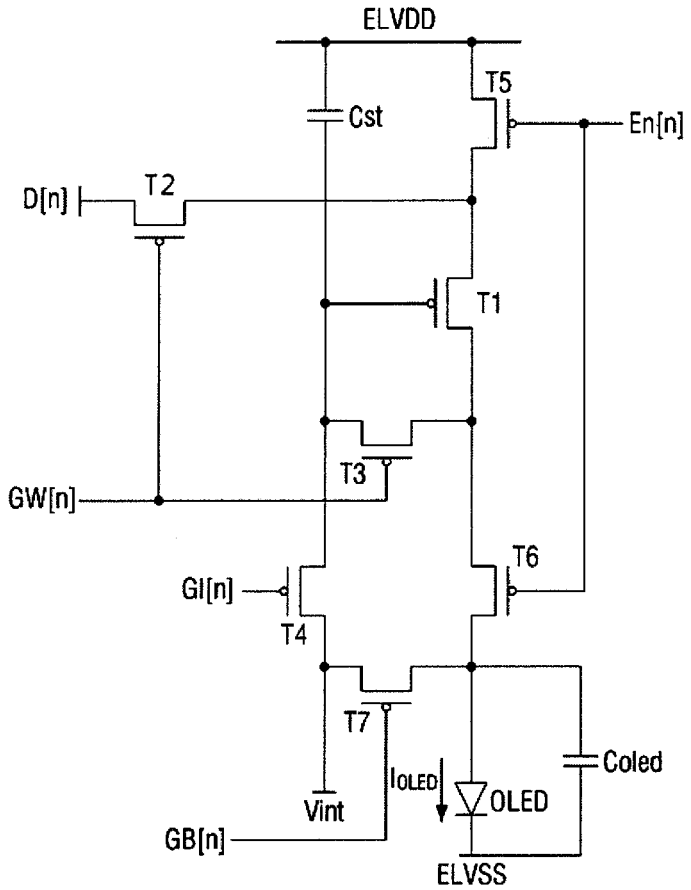
FIG. 3 is an equivalent circuit diagram of a pixel of the display device according to the exemplary embodiment of FIG. 1.

FIG. 3 is an equivalent circuit diagram of a pixel of the display device according to the exemplary embodiment of FIG. 1.

Referring to FIG. 3, a pixel of the organic light-emitting display device according to the exemplary embodiment of FIG. 1 includes a plurality of thin-film transistors (TFTs) (T1, T2, T3, T4, T5, T6, and T7), to which a plurality of signals may be applied, a storage capacitor Cst, and an organic light-emitting diode (OLED) "OLED".

The plurality of TFTs (T1, T2, T3, T4, T5, T6, and T7) may include a first TFT T1, a second TFT T2, a third TFT T3, a fourth TFT T4, a fifth TFT T5, a sixth TFT T6, and a seventh TFT T7.

The plurality of signals that may be applied to the plurality of TFTs (T1, T2, T3, T4, T5, T6, and T7) may include a scan signal GW[n], a previous scan signal GI[n], an emission control signal En[n], a data signal D[n], a first power supply voltage ELVDD, a second power supply voltage ELVSS, an initialization voltage Vint, and a black voltage signal GB[n].

The gate terminal of the first TFT T1 may be connected to a first end of the storage capacitor Cst, the source terminal of the first TFT T1 may be connected to the first power supply voltage ELVDD via the fifth TFT T5, and the drain terminal of the first TFT T1 may be electrically connected to the anode of the OLED "OLED" via the sixth TFT T6. The first TFT T1 may receive the data signal D[n] in accordance with a switching operation performed by the second TFT T2, and may apply a driving current to the OLED "OLED".

The gate terminal of the second TFT T2 may receive the scan signal GW[n], the source terminal of the second TFT T2 may receive the data signal D[n], and the drain terminal of the second TFT T2 may be connected to the source terminal of the first TFT T1, and may receive the first power supply voltage ELVDD via the fifth TFT T5. The second TFT T2 may be turned on by the scan signal GW[n], and may thus perform a switching operation so as to transmit the data signal D[n] to the source terminal of the first TFT T1.

The gate terminal of the third TFT T3 may receive the scan signal GW[n], the source terminal of the third TFT T3 may be connected to the drain terminal of the first TFT T1, and may also be connected to the anode of the OLED "OLED" via the sixth TFT T6, and the drain terminal of the third TFT T3 may be connected to the first end of the storage capacitor Cst, the drain terminal of the fourth TFT T4, and the gate terminal of the first TFT T1. The third TFT T3 may be turned on by the scan signal GW[n], and may connect the gate terminal and the drain terminal of the first TFT T1, thereby forming a diode connection.

The gate terminal of the fourth TFT T4 may receive the previous scan signal GI[n], the source terminal of the fourth TFT T4 may receive the initialization voltage Vint, and the drain terminal of the fourth TFT T4 may be connected to the first end of the storage capacitor Cst, the drain terminal of the third TFT T3, and the gate terminal of the first TFT T1. The fourth TFT T4 may be turned on by the previous scan signal GI[n], and may transmit the initialization voltage Vint to the gate terminal of the first TFT T1 so as to perform an initialization operation for initializing the voltage at the gate terminal of the first TFT T1.

The gate terminal of the fifth TFT T5 may receive the emission control signal En[n], the source terminal of the fifth TFT T5 may receive the first power supply voltage ELVDD, and the drain terminal of the fifth TFT T5 may be connected to the source terminal of the first TFT T1 and the drain terminal of the second TFT T2.

The gate terminal of the sixth TFT T6 may receive the emission control signal En[n], the source terminal of the sixth TFT T6 may be connected to the drain terminal of the first TFT T1 and the source terminal of the third TFT T3, and the drain terminal of the sixth TFT T6 may be electrically connected to the anode of the OLED "OLED" and the drain terminal of the seventh TFT T7. The fifth TFT T5 and the sixth TFT T6 may be turned on at the same time by the emission control signal En[n], and as a result, the first power supply voltage ELVDD may be transmitted to the OLED "OLED" so that a driving current flows in the OLED "OLED".

The gate terminal of the seventh TFT T7 may receive the black voltage signal GB[n], the source terminal of the seventh TFT T7 may receive the initialization voltage Vint, and the drain terminal of the seventh TFT T7 may be connected to the anode of the OLED "OLED" and the drain terminal of the sixth transistor T6. The seventh TFT T7 may be turned on by the black voltage signal GB[n], and may thus transmit the initialization voltage Vint to the anode of the OLED "OLED" so as to apply a black voltage.

A second end of the storage capacitor Cst may be connected to the first power supply voltage ELVDD, and the cathode of the OLED "OLED" may be connected to the second power supply voltage ELVSS. Accordingly, the OLED "OLED" may receive a driving current from the first TFT T1, and may thus emit light so as to display an image. The exemplary embodiment of FIG. 3 has been described, taking as an example a pixel including seven transistors and an OLED, but the invention is not limited thereto. That is, the invention is also applicable to other kinds of organic light-emitting display devices having pixels, each pixel including a plurality of transistors and an OLED.

Figure 4:
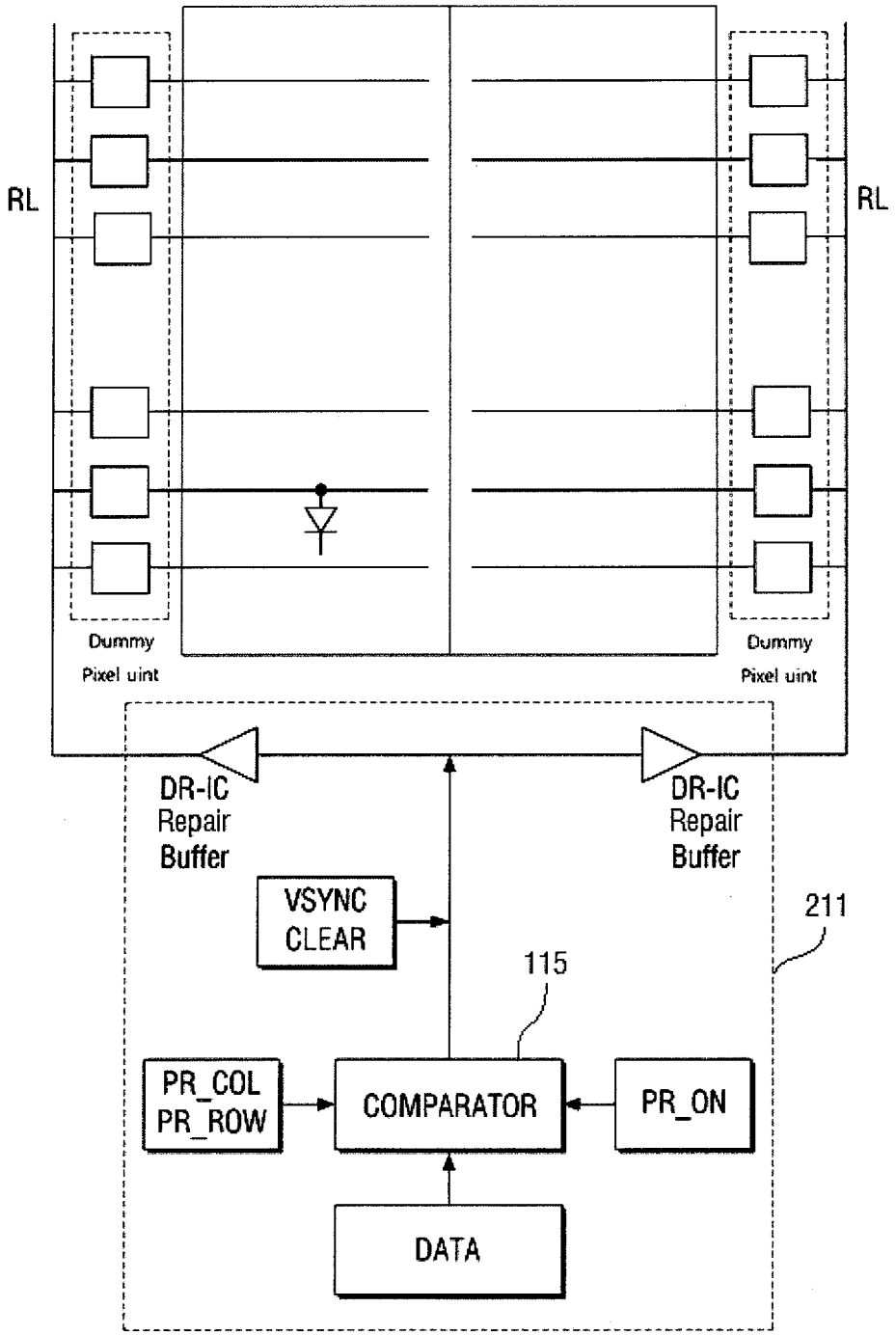
FIG. 4 is a block diagram of a control driver of the display device according to the exemplary embodiment of FIG. 1.

FIG. 4 is a block diagram of a control driver of the display device according to the exemplary embodiment of FIG. 1.

Referring to FIG. 4, two dummy pixel units may be provided on either side of a display panel 100. The dummy pixel units may be connected to a control driver 11 via a repair line RL. Each of the dummy pixel units may include a plurality of dummy driving circuits, which are provided for a plurality of scan lines, respectively. The dummy pixel units are illustrated in FIG. 4 as being provided on either end of the scan lines, but may be provided not only on either end of the scan lines, but also on either end of a plurality of data lines (not illustrated).

The control driver 11 may apply data DATA to each pixel driving circuit "Active Pixel", and may receive defect data PR_ON, regarding whether each pixel driving circuit "Active Pixel" is defective, from a sensing device (not illustrated). The sensing device may receive defect location data (PR_COL, PR_ROW) indicating the location of a pixel driving circuit "Active Pixel" where a defect has occurred. A comparator 115 of the control driver 11 may determine the location of the defective pixel driving circuit "Active Pixel" and the size of data to be applied to the defective pixel driving circuit "Active Pixel" based on the defect data PR_ON and the defect location data (PR_COL, PR_ROW), and may apply a signal corresponding to the results of the determination to the repair line RL. The signal applied by the comparator 115 to the repair line RL may be provided to the repair line RL together with a synchronization signal Vsync to be output in synchronization with a data signal, which is to be provided via the data lines. The signal applied by the comparator 115 to the repair line RL may be provided to the repair line RL via repair buffers "DR-IC Repair Buffers". The detection of a defective pixel driving circuit "Active Pixel" and the application of data to the defective pixel driving circuit "Active Pixel" are not limited to the example illustrated in FIG. 4.

Figure 5:
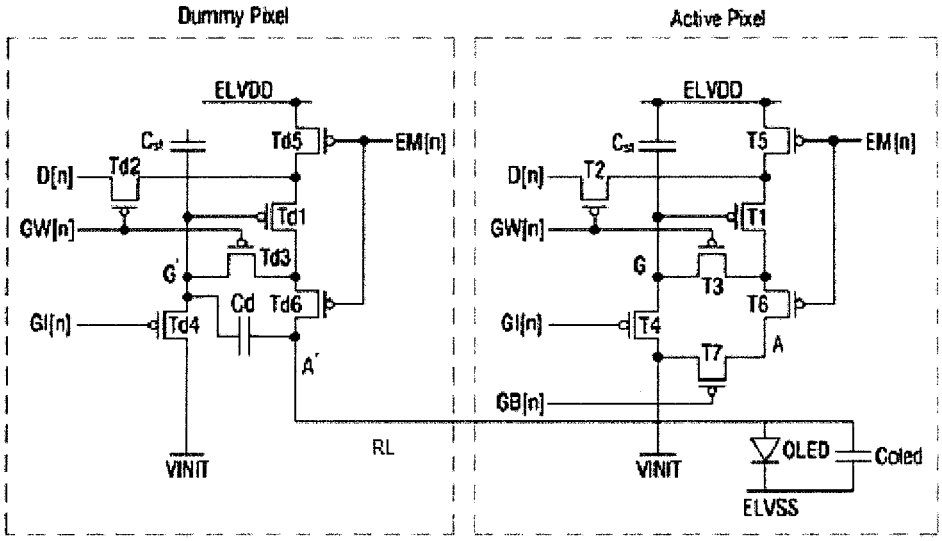
FIG. 5 is an equivalent circuit diagram of a pixel driving circuit and a dummy driving circuit of the display device according to the exemplary embodiment of FIG. 1, which are connected to each other.

FIG. 5 is an equivalent circuit diagram of a pixel driving circuit and a dummy driving circuit of the display device according to the exemplary embodiment of FIG. 1, which are connected to each other.

Referring to FIG. 5, a dummy driving circuit "Dummy Pixel" and a pixel driving circuit "Active Pixel" may be formed to have the same structure. During the fabrication of an organic light-emitting display device, defects may occur in the pixel driving circuits of some pixels, in which case, the interconnections between the defective pixel driving circuits and their respective OLEDs may be cut. That is, the drain terminals of a sixth transistor T6 and a seventh transistor T7 may be disconnected from the anode of an OLED "OLED", and the drain terminal of a sixth dummy transistor Td6 of the dummy driving circuit "Dummy Pixel" may be connected to the anode of the OLED "OLED" via an A' node of the dummy driving circuit "Dummy Pixel". The dummy driving circuit "Dummy Pixel" is illustrated in FIG. 5 as not including a seventh dummy transistor Td7, but the invention is not limited thereto. That is, the dummy driving circuit "Dummy Pixel" may include the seventh dummy transistor Td7. In a case when no electric signals are transmitted to the OLED "OLED" due to the defect in the pixel driving circuit "Active Pixel", it may not be necessary to cut the interconnection between the pixel driving circuit "Active Pixel" and the OLED "OLED".

Parasitic capacitors may be generated between a G node G of the pixel driving circuit "Active Pixel" and a terminal of the pixel driving circuit "Active Pixel" to which the scan signal GW[n] is applied and between the G node G and an A node A of the pixel driving circuit "Active Pixel". Parasitic capacitors may also be generated between a G node G' of the dummy driving circuit "Dummy Pixel" and a terminal of the dummy driving circuit "Dummy Pixel" to which the scan signal GW[n] is applied and between the G node G' and the A' node of the dummy driving circuit "Dummy Pixel". Due to these parasitic capacitors, the first TFT T1 of the pixel driving circuit "Active Pixel" and the first TFT Td1 of the dummy driving circuit "Dummy Pixel" may not be able to provide an exact driving current, corresponding to a data signal, to the OLED "OLED". Particularly, the parasitic capacitor between the G node G and the A node A of the pixel driving circuit "Active Pixel" and the parasitic capacitor between the G node G' and the A' node of the dummy driving circuit "Dummy Pixel" may increase the voltage at the G node G and the voltage at the G node G', respectively, but may affect not only the voltage at the G node G and the voltage at the G node G', respectively, but also the first TFT T1 (e.g., a voltage applied to the first TFT T1) of the pixel driving circuit "Active Pixel" and the first TFT Td1 of the dummy driving circuit "Dummy Pixel", respectively. Since the A node A of the pixel driving circuit "Active Pixel" and the A' node of the dummy driving circuit "Dummy Pixel" may be affected by voltage drops in the OLED "OLED", it may be difficult to precisely control a driving current.

However, in the case of the dummy driving circuit "Dummy Pixel", a relatively small parasitic capacitance may be generated due to a repair line RL that overlaps the pixel driving circuit "Active Pixel". Also, since the G node G' of the dummy driving circuit "Dummy Pixel" that actually receives a current and the A node A of the pixel driving circuit "Active Pixel" are physically distant from each other, the parasitic capacitor between the G node G' of the dummy driving circuit "Dummy Pixel" and the A node A of the pixel driving circuit "Active Pixel" may be negligible. Accordingly, the voltage at the G node G' of the dummy driving circuit "Dummy Pixel" may become relatively low and may thus lower the level of a driving current provided to the pixel driving circuit "Active Pixel". This phenomenon may become more apparent at high grayscale, i.e., when a high driving current flows into the OLED "OLED".

To prevent this phenomenon, a dummy capacitor Cd may be added between the G node G' and the A' node of the dummy driving circuit "Dummy Pixel" so as to increase the voltage at the G node G' of the dummy driving circuit "Dummy Pixel". As a result, an exact driving current corresponding to a desired data signal may be applied at high grayscale, i.e., when a high driving current flows. Accordingly, the OLED "OLED" can be prevented from emitting relatively little light at high grayscale.

Figure 6:
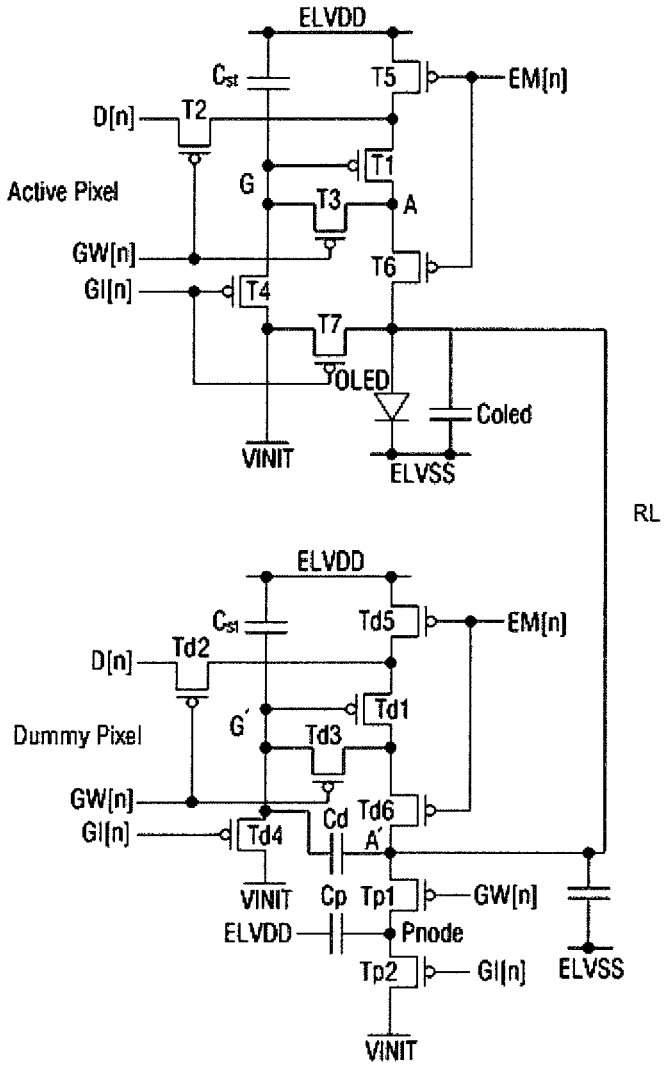
FIG. 6 is another equivalent circuit diagram of a pixel driving circuit and a dummy driving circuit of the display device according to the exemplary embodiment of FIG. 1.
Figure 7:
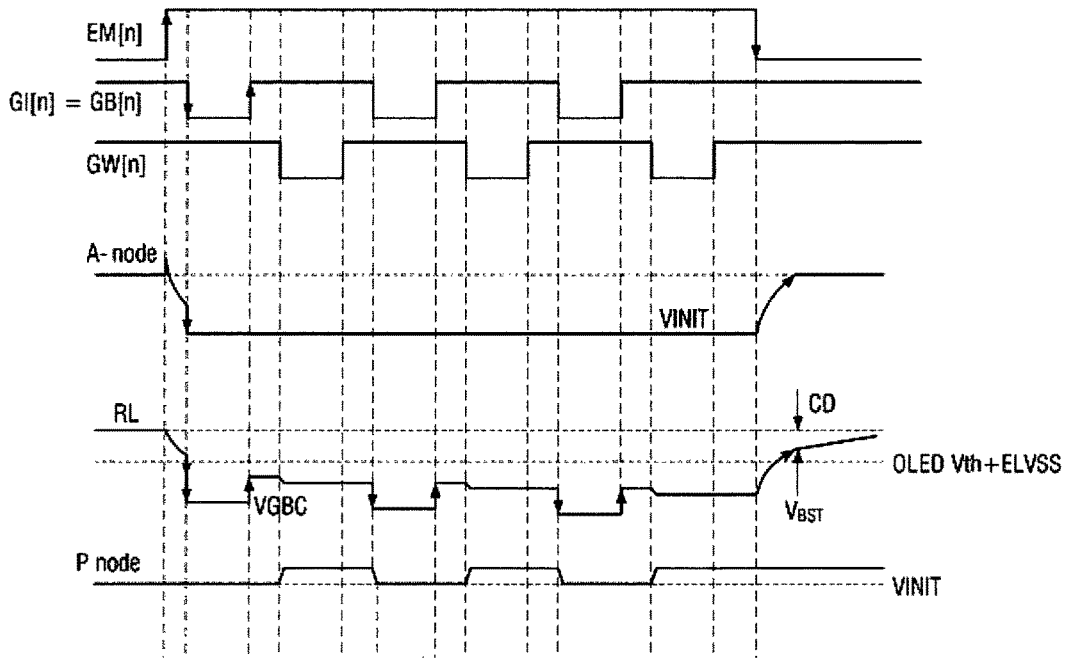
FIG. 7 is a timing diagram illustrating variations in the levels of signals applied to the display device according to the exemplary embodiment of FIG. 1.

FIG. 6 is another equivalent circuit diagram of a pixel driving circuit and a dummy driving circuit of the display device according to the exemplary embodiment of FIG. 1, and FIG. 7 is a timing diagram illustrating variations in the levels of signals applied to the display device according to the exemplary embodiment of FIG. 1.

The pixel driving circuit and the dummy driving circuit of FIG. 6 are similar to their respective counterparts of FIG. 5, and thus will hereinafter be described focusing mainly on differences with the exemplary embodiment of FIG. 5. Referring to FIG. 6, the gate terminals of a fourth transistor T4 and a seventh transistor T7 of a pixel driving circuit "Active Pixel" may be electrically connected together, and the fourth transistor T4 and the seventh transistor T7 may be driven by the same signal, i.e., an initialization signal GI[n] (which may also be referred to as a previous scan signal GI[n]) or a black voltage signal GB[n].

The pixel driving circuit "Active Pixel" and a dummy driving circuit "Dummy Pixel" may be connected to each other by a repair line RL, and the repair line RL may extend in a row direction, overlapping the pixel driving circuit "Active Pixel". Accordingly, when a defect occurs in the pixel driving circuit "Active Pixel", a driving current corresponding to a data signal can be applied to an OLED "OLED" of the pixel driving circuit "Active Pixel" because the pixel driving circuit "Active Pixel" and the dummy driving circuit "Dummy Pixel" are connected together by the repair line RL.

Since the repair line RL overlaps the pixel electrode of each pixel, a parasitic capacitor with a very large capacitance may be generated in the repair line RL.

In response to the parasitic capacitor being generated, a pixel electrode and the repair line RL may be coupled together at a predetermined voltage, and as a result, a boost voltage VBST may be generated at an A node of the pixel driving circuit "Active Pixel". The boost voltage VBST boosts the voltage to be applied to the A node A of the pixel driving circuit "Active Pixel", and as a result, the voltage at the anode of the OLED "OLED" may become higher than the voltage at the cathode of the OLED "OLED", regardless of the application of a black signal, thereby causing the emission of relatively bright light.

An initialization line (not illustrated) may be formed in parallel to the repair line RL. Due to the initialization line and the repair line RL, fringe capacitance may be generated, and may affect the pixel driving circuit "Active Pixel". That is, due to the initialization line and the repair line RL, a parasitic capacitor may be generated.

The dummy driving circuit "Dummy Pixel", unlike its counterpart of FIG. 5, may further include a first pumping transistor Tp1, which is connected to an A' node (i.e., a first dummy node) of the dummy driving circuit "Dummy Pixel", a second pumping transistor Tp2, and a pumping capacitor Cp.

The gate terminal of the first pumping transistor Tp1 may receive a scan signal GW[n], the source terminal of the first pumping transistor Tp1 may be connected to the A' node of the dummy driving circuit "Dummy Pixel", and the drain terminal of the first pumping transistor Tp1 may be connected to the source terminal of the second pumping transistor Tp2 via a pumping node Pnode.

The gate terminal of the second pumping transistor Tp2 may receive the initialization signal GI[n], the source terminal of the second pumping transistor Tp2 may be connected to the drain terminal of the first pumping transistor Tp1 via the pumping node Pnode, and the drain terminal of the second pumping transistor Tp2 may receive an initialization voltage VINIT.

The pumping capacitor Cp may connect the pumping node Pnode and a terminal to which a first power supply voltage ELVDD is applied.

The first pumping transistor Tp1 may connect the A' node of the dummy driving circuit "Dummy Pixel" and the pumping capacitor Cp in response to the receipt of the scan signal GW[n], and may thus lower the amount of charge that the parasitic capacitor generated in the repair line RL may be charged with. That is, by connecting the parasitic capacitor generated in the repair line RL and the pumping capacitor Cp in parallel, the first pumping transistor Tp1 may perform charge sharing, and may thus allow the amount of charge that only the parasitic capacitor generated in the repair line RL is charged with to be shared.

Since the dummy driving circuit "Dummy Pixel" includes the first and second pumping transistors Tp1 and Tp2 and the pumping capacitor Cp, the OLED "OLED" can be prevented from emitting relatively bright light in response to the receipt of a low-grayscale data signal. Also, since the first dummy capacitor Cd is additionally provided, as described above with reference to FIG. 5, the OLED "OLED" can be prevented from emitting relatively little light in response to the receipt of a high-grayscale data signal.

In response to the receipt of the initialization signal GI[n], the second pumping transistor Tp2 may apply the initialization voltage VINIT to the pumping node Pnode.

A first end of the pumping capacitor Cp may be connected to the pumping node Pnode, and a second end of the pumping capacitor Cp may be connected to the terminal to which the first power supply voltage ELVDD is applied. Alternatively, the second end of the pumping capacitor Cp may be connected to another terminal to which a constant voltage is applied. In an exemplary embodiment, the second pumping transistor Tp2 may not be provided.

Signals applied to each terminal of the pixel driving circuit "Active Pixel" and the voltage at each node of the pixel driving circuit "Active Pixel" will hereinafter be described with reference to FIG. 7. Referring to FIG. 7, in response to a high-level emission control signal EM[n] being applied, the voltage at the A node A of the pixel driving circuit "Active Pixel" may exponentially decrease, and may drop to as low as the initialization voltage VINIT upon the application of the initialization signal GI[n]. In response to a low-level emission control signal EM[n] being applied, the voltage at the A node A of the pixel driving circuit "Active Pixel" may increase. The voltage at the A node A of the pixel driving circuit "Active Pixel" is not affected by the initialization signal GI[n] and the scan signal GW[n].

Due to a parasitic capacitor that may be generated in the repair line RL, the voltage of the repair line RL may be coupled to, and may thus vary along with, individual signals applied to the dummy driving circuit "Dummy Pixel", for example, the initialization signal GI[n] and the scan signal GW[n].

Due to the parasitic capacitor that may be generated in the repair line RL, the voltage of the repair line RL may increase by as much as an incremental voltage VGBC.

In response to a low-level scan signal GW[n] being applied after the application of a low-level black voltage signal GB[n], the pumping capacitor Cp and the repair line RL may be connected together, and as a result, the pumping capacitor Cp may share some of the charge that the parasitic capacitor generated in the repair line RL is charged with. Accordingly, the voltage of the repair line RL may slightly decrease.

In response to the low-level black voltage signal GB[n] being applied again, the voltage of the repair line RL may drop to as low as the initialization voltage VINIT.

Thereafter, in response to the emission control signal EM[n] dropping to its low level again, the voltage of the repair line may increase, but the speed at which the repair line RL is charged may be low due to the pumping capacitor Cp. As a result, when the black voltage signal GB[n] or a low-grayscale signal is applied, the voltage of the anode of the OLED "OLED" may be maintained to be lower than the voltage of the cathode of the OLED "OLED" by as much as a charge-down voltage CD. That is, the emission of relatively bright light at low grayscale can be prevented.

The voltage at the pumping node Pnode may be maintained to be as low as the initialization voltage VINIT. However, since the parasitic capacitor generated in the repair line RL and the pumping capacitor Cp are connected together by the scan signal GW[n], the voltage at the pumping node Pnode may slightly increase, but may drop back to as low as the initialization voltage VINIT due to the black voltage signal GB[n] applied to the second pumping transistor Tp2.

The scan signal GW[n] and the black voltage signal GB[n] are illustrated in FIG. 7 as being applied three times while the emission control signal EM[n] is being maintained at its high level, but the invention is not limited thereto. That is, the scan signal GW[n] and the black voltage signal GB[n] may be applied more than three times or fewer than three times.

Figure 8:
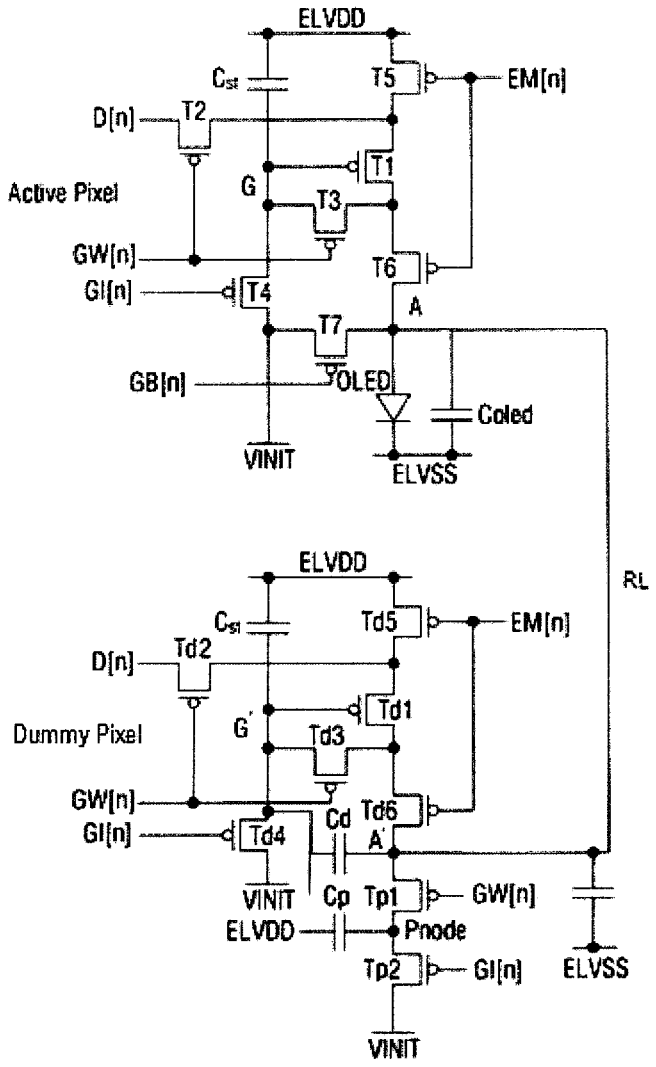
FIG. 8 is an equivalent circuit diagram of a pixel driving circuit and a dummy driving circuit of a display device according to another exemplary embodiment of the invention.
Figure 9:
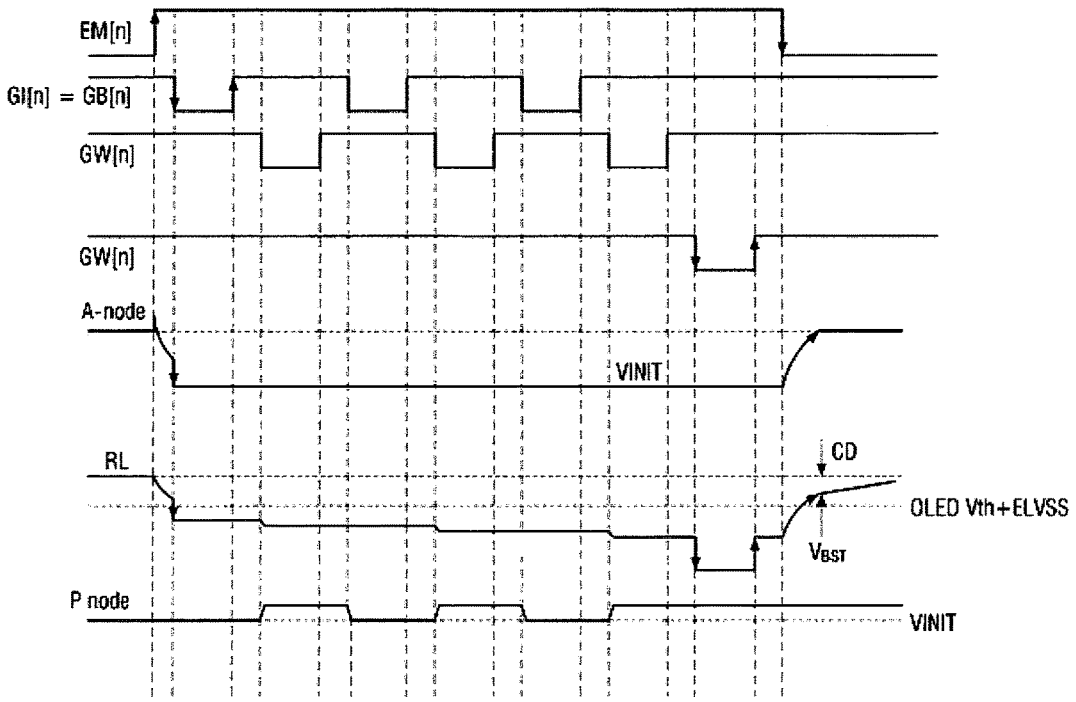
FIG. 9 is a timing diagram illustrating variations in the levels of signals applied to the display device according to the exemplary embodiment of FIG. 8.

FIG. 8 is an equivalent circuit diagram of a pixel driving circuit and a dummy driving circuit of a display device according to another exemplary embodiment of the invention, and FIG. 9 is a timing diagram illustrating variations in the levels of signals applied to the display device according to the exemplary embodiment of FIG. 8.

The pixel driving circuit and the dummy driving circuit of FIG. 8 have structures similar to those of their respective counterparts of FIG. 6, and thus, will hereinafter be described focusing mainly on differences with the exemplary embodiment of FIG. 6.

Referring to FIG. 8, the gate terminals of a fourth transistor T4 and a seventh transistor T7 of a pixel driving circuit "Active Pixel" may be electrically isolated from each other, and the fourth transistor T4 and the seventh transistor T7 may be driven by an initialization signal GI[n] and a black voltage signal GB[n], respectively.

The operations of the pixel driving circuit "Active Pixel" and a dummy driving circuit "Dummy Pixel" will hereinafter be described with reference to FIG. 9.

Referring to FIG. 9, in response to a high-level emission control signal EM[n] being applied, the voltage at an A node A of the pixel driving circuit "Active Pixel" may exponentially decrease, and may drop to as low as an initialization voltage VINIT upon the application of the initialization signal GI[n]. In response to a low-level emission control signal EM[n] being applied, the voltage at the A node A of the pixel driving circuit "Active Pixel" may increase. The voltage at the A node A of the pixel driving circuit "Active Pixel" is not affected by the initialization signal GI[n] and a scan signal GW[n].

Due to a parasitic capacitor that may be generated in the repair line RL, the voltage of a repair line RL may be coupled to, and may thus vary along with, individual signals applied to the dummy driving circuit, for example, the initialization signal GI[n] and the scan signal GW[n].

In response to a low-level scan signal GW[n] being applied after the application of a low-level initialization signal GI[n], the pumping capacitor Cp and the repair line RL may be connected together, and as a result, the pumping capacitor Cp may share some of the charge that the parasitic capacitor generated in the repair line RL is charged with. Accordingly, the voltage of the repair line RL may slightly decrease.

In response to the low-level scan signal GW[n] being applied again, the pumping capacitor Cp and the repair line RL may be connected, and the pumping capacitor Cp may share some of the charge that the parasitic capacitor generated in the repair line RL is charged with and the voltage of the repair line RL may further slightly decrease.

Thereafter, in response to a low-level black voltage signal GB[n] being applied, the voltage of the repair line RL may drop by as much as an incremental voltage VGBC to the level of the initialization voltage VINIT due to the black parasitic capacitor CGRP. In response to a high-level black voltage signal GB[n] being applied, the voltage of the repair line RL may increase by as much as the incremental voltage VGBC.

In response to the emission control signal EM[n] dropping to its low level again, the voltage of the repair line RL may increase, but the speed at which the repair line RL is charged may be low due to the pumping capacitor Cp. As a result, when the black voltage signal GB[n] or a low-grayscale signal is applied, the voltage of the anode of an OLED "OLED" may be maintained to be a charge-down voltage CD lower than the voltage of the cathode of the OLED "OLED". That is, the OLED "OLED" can be prevented from emitting relatively bright light at low grayscale.

The voltage at a pumping node Pnode may be maintained to be as low as the initialization voltage VINIT. However, since the parasitic capacitor generated in the repair line RL and the pumping capacitor Cp are connected together by the scan signal GW[n], the voltage at the pumping node Pnode may slightly increase, but may drop back to the level of the initialization voltage VINIT due to the black voltage signal GB[n] applied to a second pumping transistor Tp2.

The scan signal GW[n] and the black voltage signal GB[n] are illustrated in FIG. 9 as being applied three times while the emission control signal EM[n] is being maintained at its high level, but the invention is not limited thereto. That is, the scan signal GW[n] and the black voltage signal GB[n] may be applied more than three times or fewer than three times.

Figure 10:
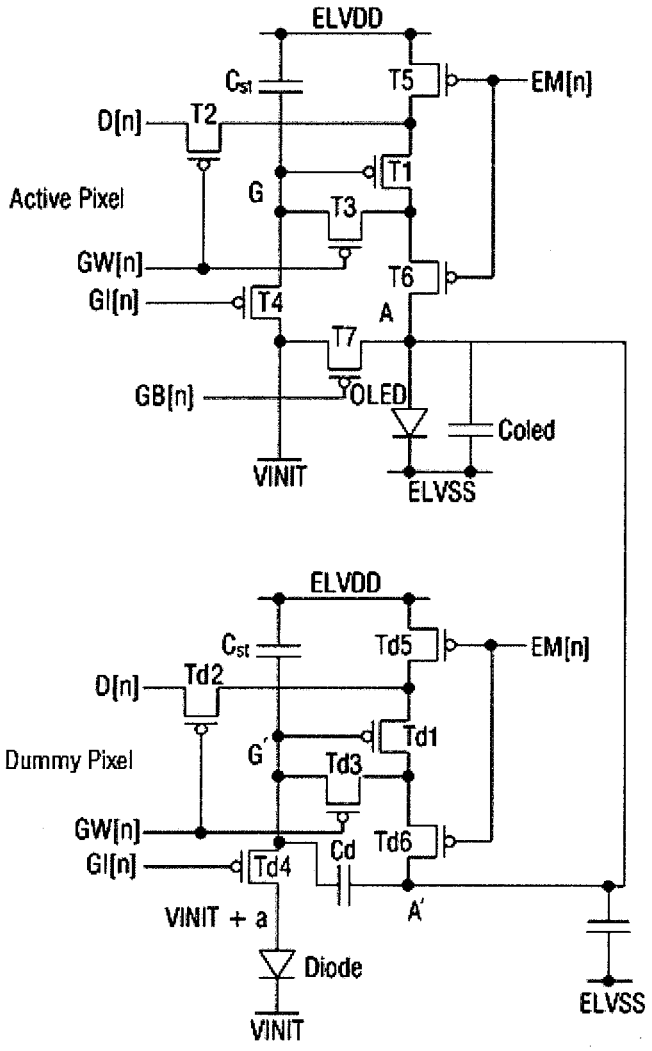
FIG. 10 is an equivalent circuit diagram of a pixel driving circuit and a dummy driving circuit of a display device according to another exemplary embodiment of the invention.

FIG. 10 is an equivalent circuit diagram of a pixel driving circuit and a dummy driving circuit of a display device according to another exemplary embodiment of the invention.

Referring to FIG. 10, the gate terminals of a fourth transistor T4 and a seventh transistor T7 of a pixel driving circuit "Active Pixel" may be electrically isolated from each other, and the fourth transistor T4 and the seventh transistor T7 may be driven by an initialization signal GI[n] and a black voltage signal GB[n], respectively.

The pixel driving circuit "Active Pixel" and a dummy driving circuit "Dummy Pixel" may be connected together by a repair line RL. Accordingly, when a defect occurs in the pixel driving circuit "Active Pixel", data can be applied to an OLED "OLED" of the pixel driving circuit "Active Pixel" because the pixel driving circuit "Active Pixel" and the dummy driving circuit "Dummy Pixel" are connected together by the repair line RL.

The dummy driving circuit "Dummy Pixel" and the pixel driving circuit "Active Pixel" may be connected together by the repair line RL, and the repair line RL may extend in a row direction, overlapping the pixel driving circuit "Active Pixel". Since the repair line RL overlaps the pixel driving circuit "Active Pixel", a parasitic capacitor with a very large capacitance may be generated in the repair line RL.

The dummy driving circuit "Dummy Pixel", unlike its counterpart of FIG. 4, may further include a boost diode Diode, which is connected to a fourth dummy transistor Td4.

The anode terminal of the boost diode Diode may be connected to the drain terminal of the fourth dummy transistor Td4, and the cathode terminal of the boost diode Diode may be connected to a terminal to which the initialization voltage is applied. Accordingly, the gate-source voltage Vgs of the first dummy transistor Td1 may be lowered, and as a result, the current that flows in an A' node of the dummy driving circuit "Dummy Pixel" and the amount of charge that the parasitic capacitor generated in the repair line RL is charged with may both be lowered. As the amount of charge that the parasitic capacitor generated in the repair line RL is charged with decreases, the boost voltage VBST may also decrease. Therefore, the emission of relatively bright light in response to the receipt of black data or low-grayscale data can be reduced.

The operations of the pixel driving circuit "Active Pixel" and the dummy driving circuit "Dummy Pixel" will hereinafter be described with reference to FIG. 11.

Figure 11:
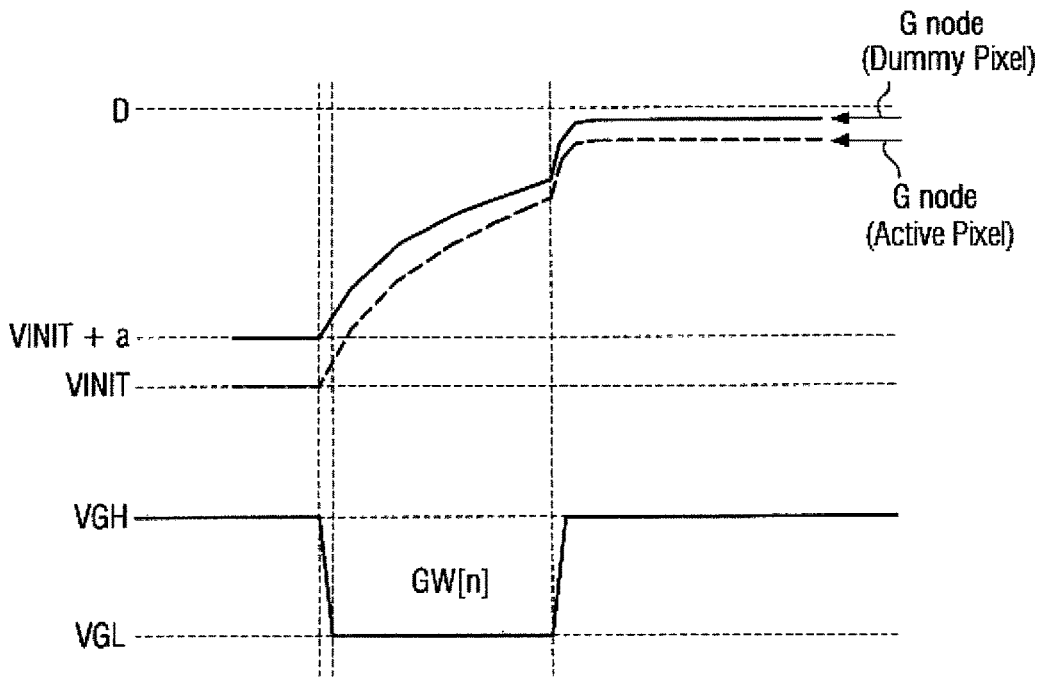
FIG. 11 is a timing diagram illustrating variations in the levels of signals applied to the display device of the exemplary embodiment of FIG. 10.

FIG. 11 is a timing diagram illustrating variations in the levels of signals applied to the display device of the exemplary embodiment of FIG. 10.

Referring to FIG. 11, in response to a low-level scan signal GW[n] being applied, the voltage at a G node G' of the dummy driving circuit "Dummy Pixel" may increase from a boosted initialization voltage "VINIT+a", which is increased from the initialization voltage VINIT due to the boost diode Diode. During the application of the low-level scan signal GW[n], the voltages of the dummy driving circuit "Dummy Pixel" and the pixel driving circuit "Active Pixel" may increase from different levels, and accordingly, the voltage at the G node G' of the dummy driving circuit "Dummy Pixel" may be maintained to be higher than the voltage at a G node G of the pixel driving circuit "Active Pixel".

Since the voltage at the G node G' of the dummy driving circuit "Dummy Pixel" may be maintained to be higher than the voltage at the G node G of the pixel driving circuit "Active Pixel", not only the gate-source voltage Vgs of the first dummy transistor Td1, but also the driving current that flows in the first dummy transistor Td1, may decrease. Accordingly, the emission of relatively bright light in response to the receipt of black data or low-grayscale data can be reduced.

In response to a high-level scan signal GW[n] being applied, the voltage at the G node G' of the dummy driving circuit "Dummy Pixel" or the voltage at the G node G of the pixel driving circuit "Active Pixel" may slightly increase due to the capacitance of a third dummy transistor Td3, and such voltage increase may vary depending on the threshold voltage of the third dummy transistor Td3 and the layout of the circuitry. For purposes of describing the present embodiment, it should be assumed that the voltage at the G node G' of the dummy driving circuit "Dummy Pixel" or the voltage at the G node G of the pixel driving circuit "Active Pixel" is uniformly maintained even in response to the receipt of the high-level scan signal GW[n].

FIGS. 12 to 15 are equivalent circuit diagrams of pixel driving circuits and dummy driving circuits of display devices according to other exemplary embodiments of the invention.

The pixel driving circuit and the dummy driving circuit of FIG. 12, 13, 14 or 15 have structures similar to those of their respective counterparts in FIG. 10, and thus will hereinafter be described focusing mainly on differences with the exemplary embodiment of FIG. 10.

Figure 12:
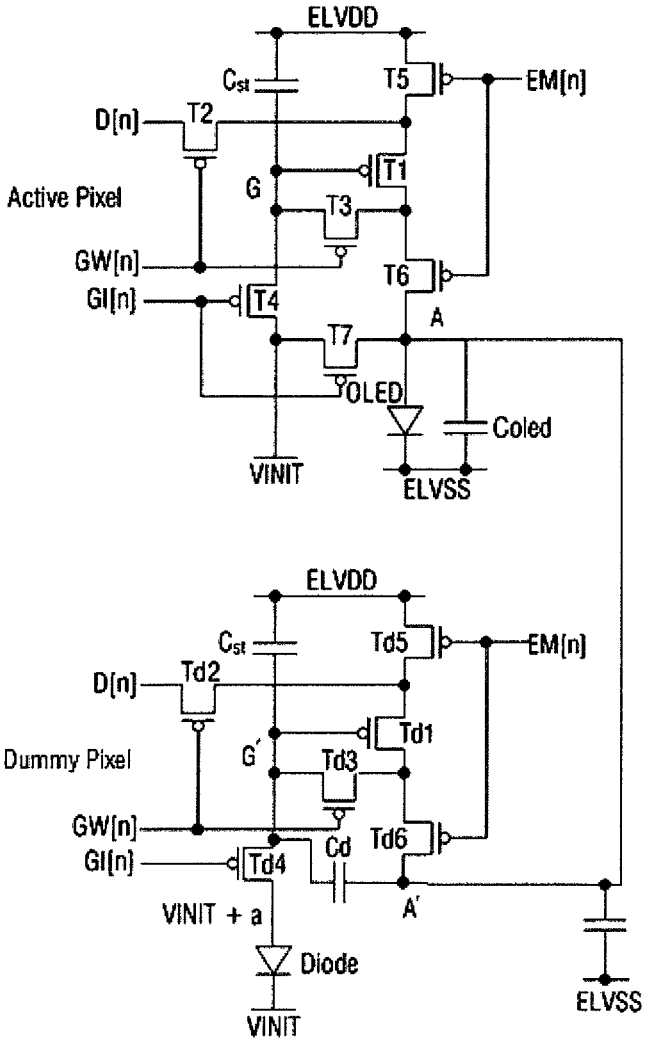
FIGS. 12 to 15 are equivalent circuit diagrams of pixel driving circuits and dummy driving circuits of display devices according to other exemplary embodiments of the invention.

Referring to FIG. 12, the gate terminals of a fourth transistor T4 and a seventh transistor T7 of a pixel driving circuit "Active Pixel" may be electrically connected to each other, and the fourth transistor T4 and the seventh transistor T7 may be driven by the same signal, i.e., an initialization signal GI[n] or a black voltage signal GB[n].

Since the gate terminals of the fourth transistor T4 and the seventh transistor T7 are electrically connected together, the voltage of a repair line RL may increase by as much as an incremental voltage VGBC at the rising edge of the initialization signal GI[n].

Figure 13:
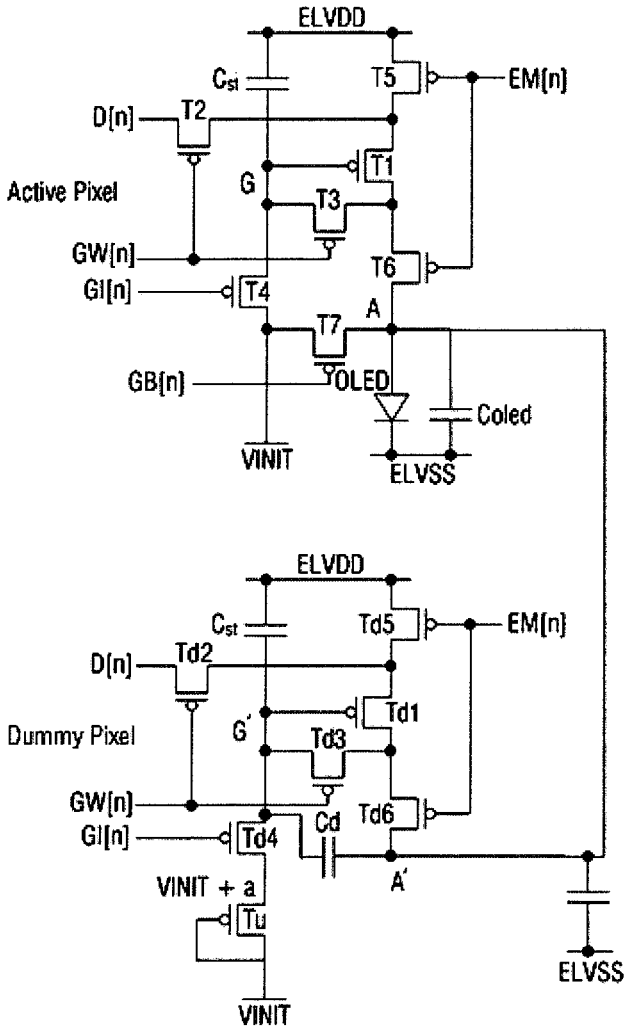

Referring to FIG. 13, a dummy driving circuit "Dummy Pixel" may include a boost transistor Tu, instead of the boost diode Diode of FIG. 10. The gate terminal and the drain terminal of the boost transistor Tu may be connected together, thereby forming a diode connection. Due to the diode connection, the boost transistor Tu may serve as a diode, and may apply a boosted initialization voltage "VINIT+a", which is increased from an initialization voltage VINIT by as much as the threshold voltage of the boost transistor Tu, to a fourth dummy transistor Td4.

Accordingly, not only the gate-source voltage Vgs of a first dummy transistor Td1, but also the current that flows in an A' node of the dummy driving circuit "Dummy Pixel", may decrease. As a result, the amount of charge that a parasitic capacitor generated in a repair line RL is charged with may decrease, and a boost voltage VBST may also decrease. Therefore, the emission of relatively bright light in response to the receipt of black data or low-grayscale data can be reduced.

The gate terminals of a fourth transistor T4 and a seventh transistor T7 of a pixel driving circuit "Active Pixel" are illustrated in FIG. 12 as being electrically isolated from each other, but the invention is not limited thereto. That is, the invention is also applicable to a case in which the gate terminals of the fourth transistor T4 and the seventh transistor T7 of the pixel driving circuit "Active Pixel" are connected to each other.

Figure 14:
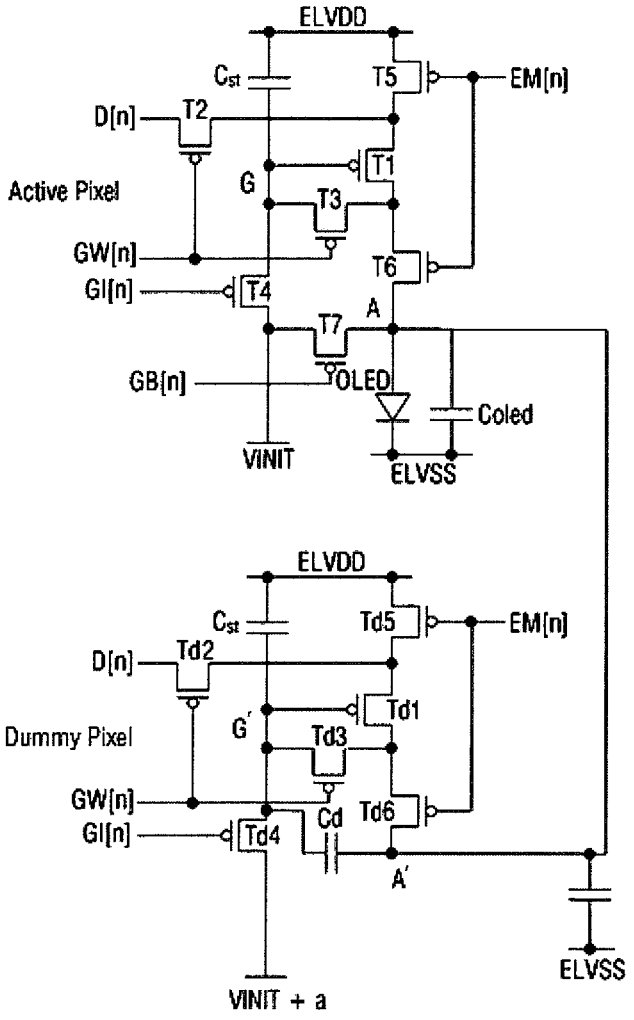

Referring to FIG. 14, a boosted voltage may be directly applied to a fourth dummy transistor Td4 without the aid of the boost diode Diode of FIG. 10. That is, by applying a boosted initialization voltage "VINIT+a" to the fourth dummy transistor Td4, the gate-source voltage Vgs of a first dummy transistor Td1 may be lowered. As the gate-source voltage Vgs of a first dummy transistor Td1 decreases, not only the current that flows in an A' node of a dummy driving circuit "Dummy Pixel", but also the amount of charge that a parasitic capacitor generated in a repair line RL is charged with, may also decrease. As a result, a boost voltage VBST may also decrease. Therefore, the emission of relatively bright light in response to the receipt of black data or low-grayscale data can be reduced.

Figure 15:
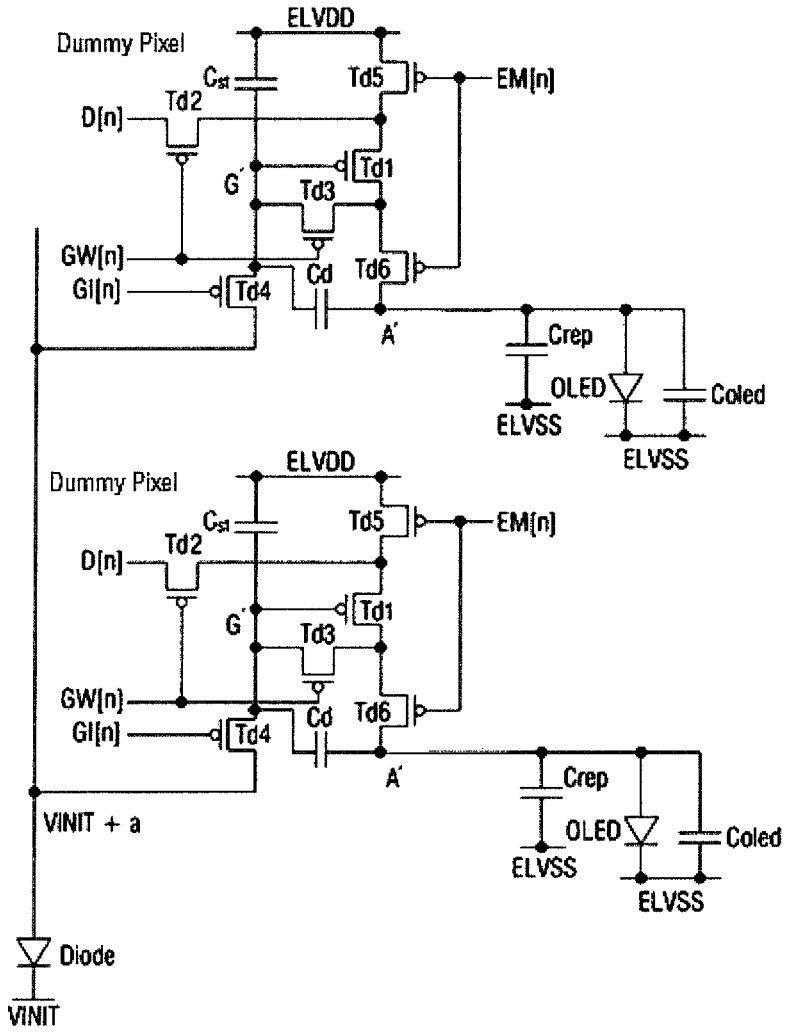

Referring to FIG. 15, a boost diode Diode may be provided for a line of a plurality of dummy driving circuits "Dummy Pixel", rather than for a single dummy driving circuit. The boost diode Diode may be an additional element provided to apply a boosted initialization voltage higher than an initialization voltage VINIT to fourth dummy transistors Td4 of the plurality of dummy driving circuits "Dummy Pixel". Even in a case when the fourth dummy transistors Td4 of the plurality of dummy driving circuits "Dummy Pixel" are all connected to the anode terminal of the boost diode Diode, the boost diode Diode may lower all the driving currents of first dummy transistors Td1 of the plurality of dummy driving circuits "Dummy Pixel".

FIG. 15 illustrates an example of how to connect the boost diode Diode to the plurality of dummy driving circuits "Dummy Pixel", but the invention is not limited to the example of FIG. 15. That is, the source terminal of the boost diode Diode may be connected to the drain terminals of the fourth dummy transistors Td4 of the plurality of dummy driving circuits "Dummy Pixel", or a boosted voltage may be applied to the drain terminals of the fourth dummy transistors Td4 of the plurality of dummy driving circuits "Dummy Pixel".

Figure 16:
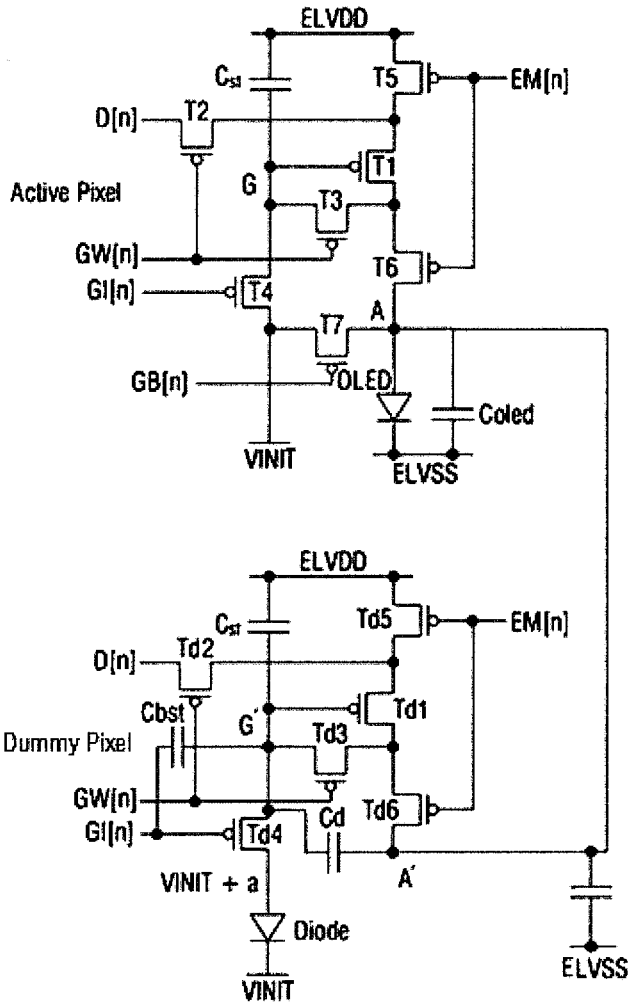
FIG. 16 is an equivalent circuit diagram of a pixel driving circuit and a dummy driving circuit of a display device according to another exemplary embodiment of the invention.
Figure 17:
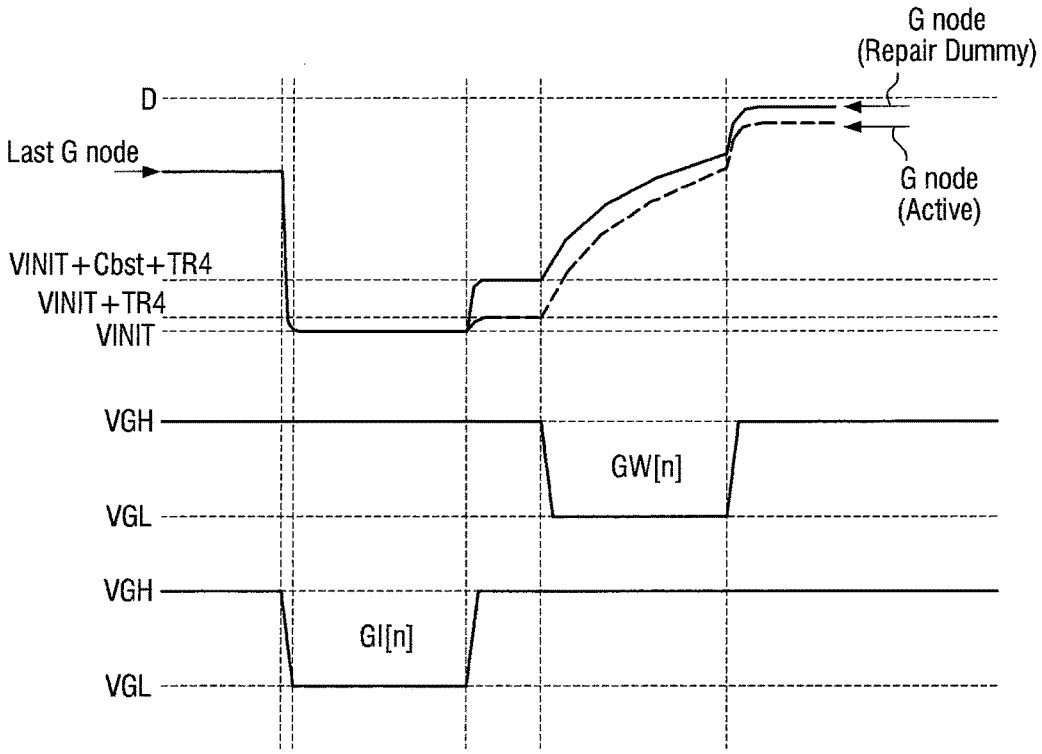
FIG. 17 is a timing diagram illustrating variations in the levels of signals applied to the display device of the exemplary embodiment of FIG. 16.

FIG. 16 is an equivalent circuit diagram of a pixel driving circuit and a dummy driving circuit of a display device according to another exemplary embodiment of the invention, and FIG. 17 is a timing diagram illustrating variations in the levels of signals applied to the display device of the exemplary embodiment of FIG. 16.

The pixel driving circuit and the dummy driving circuit of FIG. 16 have structures similar to those of their respective counterparts in FIG. 12, and thus, will hereinafter be described focusing mainly on differences with the exemplary embodiment of FIG. 12.

Referring to FIG. 16, the gate terminals of a fourth transistor T4 and a seventh transistor T7 of a pixel driving circuit "Active Pixel" may be electrically isolated from each other, and the fourth transistor T4 and the seventh transistor T7 may be driven by an initialization signal GI[n] and a black voltage signal GB[n], respectively.

A dummy driving circuit "Dummy Pixel", unlike the dummy driving circuit of FIG. 12, may further include a boost capacitor Cbst, which connects a terminal to which the initialization signal GI[n] is applied and a G node G' of the dummy driving circuit "Dummy Pixel".

More specifically, the boost capacitor Cbst may be connected to the G node G' of the dummy driving circuit "Dummy Pixel", and may boost the voltage at the G node G' of the dummy driving circuit "Dummy Pixel" in response to a high-level initialization signal GI[n] being applied. Accordingly, the gate-source voltage Vgs of a first dummy transistor Td1 may be lowered, and as a result, the current that flows in the anode of the dummy driving circuit "Dummy Pixel" and the amount of charge that a parasitic capacitor generated in a repair line RL is charged with may both be lowered. As the amount of charge that the parasitic capacitor generated in a repair line RL is charged with decreases, a boost voltage VBST may also decrease. Therefore the emission of relatively bright light in response to the receipt of black data or low-grayscale data can be reduced.

The gate terminals of the fourth transistor T4 and the seventh transistor T7 are illustrated in FIG. 16 as being electrically isolated from each other, but the invention is not limited thereto. That is, the invention is also applicable to a case in which the gate terminals of the fourth transistor T4 and the seventh transistor T7 are connected to each other.

The operations of the pixel driving circuit "Active Pixel" and the dummy driving circuit "Dummy Pixel" will hereinafter be described with reference to FIG. 17.

Referring to FIG. 17, in response to the transition of the initialization signal GI[n] from a low level to a high level, the boost capacitor Cbst, which is connected to a terminal to which the initialization signal GI[n] is applied, is charged with a higher voltage than a voltage increased from an initialization voltage VINIT due to the parasitic capacitance of a fourth dummy transistor Td4.

The voltage at the G node G' of the dummy driving circuit "Dummy Pixel" may be increased by the initialization signal GI[n]. In response to a low-level scan signal GW[n] being applied, the voltage at the G node G' of the dummy driving circuit "Dummy Pixel" may increase from a boosted initialization voltage, which is increased from the initialization voltage due to the boost capacitor Cbst and the parasitic capacitance of the fourth dummy transistor Td4. Since the voltages of the dummy driving circuit "Dummy Pixel" and the pixel driving circuit "Active Pixel" increase from different levels during the application of the low-level scan signal GW[n], the voltage at the G node G' of the dummy driving circuit "Dummy Pixel" may be maintained to be higher than the voltage at the G node G of the pixel driving circuit "Active Pixel".

Since the voltage at the G node G' of the dummy driving circuit "Dummy Pixel" may be maintained to be higher than the voltage at the G node G of the pixel driving circuit "Active Pixel", not only the gate-source voltage Vgs of the first dummy transistor Td1, but also the driving current that flows in the first dummy transistor Td1, may decrease. Accordingly, the emission of relatively bright light in response to the receipt of black data or low-grayscale data can be reduced.

In response to a high-level scan signal GW[n] being applied, the voltage at the G node G' of the dummy driving circuit "Dummy Pixel" or the voltage at the G node G of the pixel driving circuit "Active Pixel" may slightly increase due to the capacitance of a third dummy transistor Td3, and such voltage increase may vary depending on the threshold voltage of the third dummy transistor Td3 and the layout of the circuitry. For purposes of describing the present embodiment, it should be assumed that the voltage at the G node G' of the dummy driving circuit "Dummy Pixel" or the voltage at the G node G of the pixel driving circuit "Active Pixel" is uniformly maintained even in response to the receipt of the high-level scan signal GW[n].

While the invention has been particularly shown and described with reference to exemplary embodiments thereof, it will be understood by those of ordinary skill in the art that various changes may be made thereto without departing from the spirit and scope of the invention as defined by the following claims, and equivalents thereof. The exemplary embodiments should be considered in a descriptive sense only and not for purposes of limitation.

What is claimed is:

1. A display device, comprising:

a display panel comprising a plurality of active pixels and a plurality of dummy pixels located at one or both ends of the display panel in a first direction, wherein each of the active pixels comprises:

an organic light-emitting diode;

a pixel driving circuit that is configured to drive the organic light-emitting diode, and that comprises a pixel driving transistor; and a driving storage capacitor coupled between a control terminal of the pixel driving transistor and a first power supply voltage terminal, and wherein each of the dummy pixels comprises:

a dummy driving circuit that comprises a dummy driving transistor, and a dummy emission control transistor configured to receive an emission control signal at a control terminal thereof;

a dummy storage capacitor coupled between a control terminal of the dummy driving transistor and the first power supply voltage terminal; and a first dummy capacitor comprising a first node, which is directly connected to the control terminal of the dummy driving transistor, and a second node, which is directly connected to both a drain electrode of the dummy emission control transistor and the organic light-emitting diode of a corresponding one of the active pixels.

2. The display device of claim 1, further comprising a repair line configured to extend in the first direction, and overlapping the active pixels aligned in the first direction.

3. The display device of claim 2, wherein the repair line is electrically connected to the pixel driving circuits of some of the active pixels at first pixel nodes thereof.

4. The display device of claim 3, further comprising a control driver that is configured to control the pixel driving circuit and the dummy driving circuit, and that comprises:

a comparator that is configured to determine whether or not the pixel driving circuit is defective; and a synchronizer that is configured to synchronize an output signal of the dummy driving circuit with a data signal provided to the pixel driving circuit.

5. The display device of claim 4, wherein the comparator is configured to control a connection between the repair line and one or more of the first pixel nodes.

6. The display device of claim 1, wherein the dummy driving circuit comprises a first dummy transistor and a second dummy transistor, which connect a terminal to which an initialization voltage is applied and a first dummy node, and a pumping capacitor, to which the first and second dummy transistors are connected, wherein a control terminal of the first dummy transistor is connected to a first input signal terminal, wherein a source terminal of the first dummy transistor is connected to the first dummy node, wherein a drain terminal of the first dummy transistor is connected to a source terminal of the second dummy transistor, wherein a control terminal of the second dummy transistor is connected to a second input signal terminal, wherein the source terminal of the second dummy transistor is connected to the drain terminal of the first dummy transistor, and wherein a drain terminal of the second dummy transistor is connected to a second power supply voltage terminal.

7. The display device of claim 6, wherein each of the pixel driving circuits of the active pixels comprises a first pixel transistor and a second pixel transistor, wherein a control terminal of the first pixel transistor is connected to the second input signal terminal, and wherein a control terminal of the second pixel transistor is connected to a third input signal terminal.

8. The display device of claim 6, wherein each of the pixel driving circuits of the active pixels comprises a first pixel transistor and a second pixel transistor, wherein a control terminal of the first pixel transistor and a control terminal of the second pixel transistor are electrically connected together, and wherein the control terminal of the first pixel transistor is connected to the second input signal terminal.

* * * * *